US011374330B2

(12) United States Patent
Basnev et al.

(10) Patent No.: US 11,374,330 B2
(45) **Date of Patent: *Jun. 28, 2022**

(54) MULTI-BEAM ANTENNA (VARIANTS)

(71) Applicants: Evgenij Petrovich Basnev, Korolev (RU); Anatolij Vasilevich Vovk, Korolev (RU)

(72) Inventors: Evgenij Petrovich Basnev, Korolev (RU); Anatolij Vasilevich Vovk, Korolev (RU)

( * ) Notice: Subject to any disclaimer, the term of this patent is extended or adjusted under 35 U.S.C. 154(b) by 668 days.

This patent is subject to a terminal disclaimer.

(21) Appl. No.: 16/335,015

(22) PCT Filed: Aug. 21, 2017

(86) PCT No.: PCT/RU2017/050078

§ 371 (c)(1),
(2) Date: Mar. 20, 2019

(87) PCT Pub. No.: WO2018/063038

PCT Pub. Date: Apr. 5, 2018

(65) Prior Publication Data

US 2019/0252793 A1 Aug. 15, 2019

(30) Foreign Application Priority Data

Oct. 1, 2016 (RU) ..... RU2016138755

(51) Int. Cl.
*H01Q 19/06* (2006.01)
*H01Q 3/24* (2006.01)
*H01Q 19/17* (2006.01)

(52) U.S. Cl.
CPC ..... *H01Q 19/06* (2013.01); *H01Q 3/24* (2013.01); *H01Q 19/17* (2013.01)

(58) Field of Classification Search
CPC ..... H01Q 19/06; H01Q 3/24; H01Q 19/17
See application file for complete search history.

(56) References Cited

U.S. PATENT DOCUMENTS 3,984,840 A 10/1976 Dell-Imagine
4,203,105 A 5/1980 Dragone et al.
(Continued)

FOREIGN PATENT DOCUMENTS

EP 2221919 A1 8/2010
JP 5014193 A 9/2009
(Continued)

OTHER PUBLICATIONS

International Search Report dated Nov. 17, 2017 for corresponding International Application No. PCT/RU2017/050071, filed Aug. 7, 2017.
(Continued)

*Primary Examiner* — Vladimir Magloire
*Assistant Examiner* — Nazra Nur Waheed
(74) *Attorney, Agent, or Firm* — David D. Brush; Westman, Champlin & Koehler, P.A.

(57) ABSTRACT

A multi-beam telecommunications antenna system with a focusing device including a two-dimensional radiator array generating a plurality of beams simultaneously by setting amplitude-time parameters of the signals for each radiator. The antenna includes: a focusing system having an amplifying lens; a radiating device, for irradiating the amplifying lens and having a two-dimensional radiator array, is disposed at a distance from the amplifying lens and covers a projection area of beams at this distance; and a beam forming system. At least one sub-array of the radiators provides a beam in a set direction. For each beam, the beam forming system provides, for each radiator in the corresponding sub-array, amplitude-time parameters of the signal being transmitted to form a non-planar wavefront, which is equidistant across the amplifying lens to a planar wavefront of the beam. The radiating surface of the radiator array is
(Continued)

outside a region of self-intersection of the non-planar wavefronts.

8 Claims, 5 Drawing Sheets

(56) References Cited

U.S. PATENT DOCUMENTS

| | | | | |
|---|---|---|---|---|
| 4,965,587 | A | 10/1990 | Lenormand et al. | |
| 5,280,297 | A | 1/1994 | Profera, Jr. | |
| 5,576,721 | A * | 11/1996 | Hwang | H01Q 25/007 343/753 |
| 5,959,578 | A | 9/1999 | Kreutel, Jr. | |
| 6,147,656 | A | 11/2000 | Luh | |
| 7,889,129 | B2 | 2/2011 | Fox et al. | |
| 2006/0267851 | A1 * | 11/2006 | Turner | H01Q 1/288 343/781 CA |
| 2015/0061930 | A1 | 3/2015 | Runyon | |

FOREIGN PATENT DOCUMENTS

| | | | |
|---|---|---|---|
| JP | 2009200704 | A * | 9/2009 |
| JP | 2009200704 | A | 9/2009 |
| RU | 2084059 | C1 | 7/1997 |
| RU | 2626023 | C2 | 7/2017 |
| RU | 2015157178 | A | 7/2017 |

OTHER PUBLICATIONS

Written Opinion of the International Searching Authority dated Nov. 23, 2017 for corresponding International Application No. PCT/RU2017/050071, filed Aug. 7, 2017.

International Search Report dated Nov. 17, 2017 for corresponding International Application No. PCT/RU2017/050078, filed Aug. 21, 2017.

Written Opinion of the International Searching Authority dated Nov. 23, 2017 for corresponding International Application No. PCT/RU2017/050078, filed Aug. 21, 2017.

English translation of the International Search Report dated Nov. 17, 2017 for corresponding International Application No. PCT/RU2017/050071, filed Aug. 7, 2017.

English translation of the Written Opinion of the International Searching Authority dated Nov. 23, 2017 for corresponding International Application No. PCT/RU2017/050071, filed Aug. 7, 2017.

English translation of the International Search Report dated Nov. 17, 2017 for corresponding International Application No. PCT/RU2017/050078, filed Aug. 21, 2017.

English translation of the Written Opinion of the International Searching Authority dated Nov. 23, 2017 for corresponding International Application No. PCT/RU2017/050078, filed Aug. 21, 2017.

Notice of Allowance dated May 18, 2020 for corresponding U.S. Appl. No. 16/335,010, filed Mar. 20, 2019.

* cited by examiner

B

MULTI-BEAM ANTENNA (VARIANTS)

CROSS-REFERENCE TO RELATED APPLICATIONS

This Application is a Section 371 National Stage Application of International Application No. PCT/RU2017/050078, filed Aug. 21, 2017, the content of which is incorporated herein by reference in its entirety, and published as WO 2018/063038 on Apr. 5, 2018, not in English.

FIELD OF THE DISCLOSURE

The invention relates to telecommunication multi-beam antenna systems with a focal device, consisting of a two-dimensional array of feeds, in which many beams are simultaneously generated by setting the amplitude-time parameters of the signals for each feed.

BACKGROUND OF THE DISCLOSURE

Currently, there is a need for Ka-band multi-beam antennas for geostationary spacecraft, that have a large enough service area, about 12×10 degrees on the Earth's surface, with a beam width of about 0.25 degrees, with a number of subscriber beam positions of 1000-2000, and the gain is not less than 55 dBi.

At the same time, the number of active channels is approximately an order of magnitude smaller than the positions of the beams and subscribers are serviced by quickly switching active channels between positions (beam hopping) with a visit time interval of the active position no more than 125 ms (to enable voice transmission) and a visit time of 1-12 ms (data superframe length).

Such a beam width and gain, at small angles of beam deflection, can be implemented for any traditional scheme of reflector antenna with an aperture of about Ø3 m. But at the same time, due to aberration effects, there is a drop in the gain by 6 . . . 10 dB and an increase in the width of the rays to 0.5 . . . 1.0 degrees at the edges of the service area. In addition, to place the required number of fixed feeders for such a density of positions and size of the service area is almost impossible.

Such a beam width and an any number of beam positions can be realized in Active Electronically-Scanned Array (AESA), but the required gain and minimization of the grating lobes can be ensured by two mutually exclusive ways:

Or almost completely get rid of the grating lobes, which implies weakly directed partial feeders with a lattice spacing of about one wavelength. In this case there will be an insignificant, no more than 1 . . . 3 dB drop at the edges of the service area, but the grating with an aperture of Ø3 m and a hexagonal grid step equal to the wavelength (transmission, 20 GHz) should have about 36 thousand partial feeders. With the current level of technology is almost impossible.

Or use highly directional partial feeders with a diameter of 6-8 wavelengths. But the lattice with such feeders will have a gain drop at the edges of the service area, about 6 . . . 10 dB, and the grating lobes become unacceptably powerful and may even exceed the level of the main beam with large deviations. The use of an aperiodic lattice with highly directional partial feeders, for example, an annular one, somewhat improves the position with the grating lobes, "smearing" them around the annular region and reducing their level by 15 . . . 20 dB. But with extreme deviations of the beam, this annular region can still get to the surface of the Earth, which is highly undesirable. In addition, there is the problem of satellite illumination on the opposite side of the geostationary orbit. However, this kind of phased array can be a good compromise, especially if you can make such a grid uncontrollable.

There are various schemes of reflector antennas with an irradiating device (ID) on the basis of a phased array (Phased Array Feed Reflector, PAFR). The advantage of such schemes is that a fairly simple focusing device provides the necessary aperture, and the difficult to implement active phased array has small dimensions. Such a lattice can form multiple focal radiation centers (virtual irradiators) using certain subarrays of partial feeders.

In such an ID, the grating lobes can be almost completely removed, since, due to the much smaller area of the ID, the lattice spacing can be reduced.

They can also be significantly reduced in the far zone of the antenna, since in the zone between the ID and the focusing system, they are not a rotated flat wave front, but a rotated spherical wave front and mostly go beyond the focusing system. In addition, a certain aperiodicity of placement of partial feeders can be made by placing them on the concave spherical surface of an ID, providing approximately the same viewing angle of the focusing system for each partial feeder. But this scheme does not eliminate the main drawback of systems with a focusing system and a point feeder. All of them have optical aberrations (mostly coma), and can realize a rather small coverage area with given beam parameters.

In the invention [JP 5014193], adopted by the authors for the prototype, an attempt was made to form virtual irradiators, to some extent taking into account the problem of aberrational distortion.

This invention has a focusing system consisting of one or a plurality of reflectors, an ID, consisting of an array of partial feeders, covering the radiation zone of the focusing system and located closer or further to the focal point of the focusing system, and a beamforming system controlling the amplitude and phase parameters of the feeders in the subarrays, corresponding to each ray. This invention involves measuring (or calculating) the amplitude-phase characteristics of the incoming beam for each feeder in a subarray, limited by the projection of the aperture from the incoming beam on the ID surface, and assigning these characteristics to the same feeders to form the outgoing beam.

The disadvantage of this method is that the simple definition and setting of the phase (phase shift) for each feeder will lead to the common problems of all phased arrays on phase shifters:

- low positioning accuracy of the rays and a large phase error, since the bit depth of the phase shifters, as a rule, does not exceed 6-8 bits;
- intersymbol interference, which will lead to a significant reduction in the signal bandwidth;
- the dependence of the angle of direction of the beam from the frequency, which will lead to the "spreading" of the radiation pattern along the spectrum of the modulated carrier frequency—an analogue of chromatic aberration in optics.

However, due to the relatively small size of the lattice, these problems can be eliminated by a beamforming system with true time delays, which is supposed in this invention.

A more serious disadvantage is the lack of criteria for optimizing the geometry of the surfaces of the focusing system and the relative position of the ID and the focusing system. There is also a problem with power amplifiers of feeders for a transmitting ID with sub-arrays of feeders (to be discussed below).

The objective of this invention is the creation of a class of antennas, completely or partially free from these disadvantages, while maintaining the main advantages:

separation of tasks "formation of beams", "providing the necessary aperture" and "providing power";

providing a large number of active rays.

SUMMARY

In the first variant, this problem is solved by the fact that in a multi-beam antenna, containing a focusing system, an irradiating device, designed to irradiate a focusing system, consisting of a two-dimensional array of feeders, placed at a distance from the focusing system and overlapping the area of beam projections at this distance, and the beamforming system, while the irradiating device contains at least one subarray of partial feeders, providing one beam in a given direction, the focusing system is designed as an amplifying lens, and for each such beam, the beamforming system provides such amplitude-time parameters of the transmitted radio signal for each partial feeder in its sub-array, to form a non-planar wave front, equidistant through the amplifying lens to the plane wave front of such a beam, while the radiating surface of the irradiating device is outside of the self-intersection zone of non-planar wave fronts.

In the second variant, this problem is solved by the fact that in a multi-beam antenna, containing a focusing system, an irradiating device, designed to irradiate a focusing system, consisting of a two-dimensional array of feeders, placed at a distance from the focusing system and overlapping the zone of beam projections at this distance, and the beamforming system, while the irradiating device contains at least one subarray of feeders, providing one beam in a given direction, the focusing system is designed as amplifying lens with partial feeders, containing photodetectors on the side of the irradiating device, and the irradiating device contains feeders as light sources, amplitude-modulated by a radio signal, and for each such beam the beamforming system provides such amplitude-time parameters for each feeder in its subarray to form a non-planar wave front of an amplitude-modulated signal, equidistant through an amplifying lens to a flat wave front of such a beam, while the radiating surface of the irradiating device is outside of the self-intersection zone of non-planar wave fronts.

In both variants, the refractive surface of the amplifying lens can be made as a surface of revolution with a continuous second derivative, and with an axis of revolution that does not coincide in angle and (or) position with the axes of the amplifying lens and (or) the irradiation device. Also, the refractive surface of the amplifying lens can be made as a pulling surface of the forming curves with a continuous second derivative.

The amplifying lens in this invention is interpreted as a two-dimensional array of partial feeders, containing, at a minimum, a receiving element, a delay line, an amplifier, and a transmitting element. Amplifying lens can be either a feedthrough, with receiving and transmitting elements on different surfaces, or reflective, with receiving and transmitting elements on one surface. Amplifying lens can be transmitting, receiving, or transmitting-receiving. Accordingly, the irradiating device consisting of a two-dimensional array of low-power feeders can be transmitting, receiving, or transmitting-receiving.

The multi-beam antenna in this invention may be transmitting, receiving, or transmitting-receiving with different variations of the polarization of the radio signal. In this description, two variants of the transmitting antenna are considered. Variants of the receiving antenna are obtained by inverting the transmitting and receiving elements.

The concept of "equidistant" is interpreted as a mapping of the wave front 5*c* to the wave front 5*a* through a certain time constant.

Features of solid-state power amplifiers (PA) impose some restrictions on the use of the prototype in the transmitting antennas. The fact is that powerful transistors have, as a rule, a normally-open channel. In this case, the energy consumption in the absence of a signal at the input practically does not decrease, and the time of entry into the linear mode is comparable with the time between visits with a jumping beam (beam hopping) of any position. Accordingly, if there is a radiation position with at least one subscriber, all partial feeders in the subarray for this position must be constantly powered. Of course, each partial feeder serves more than a hundred positions in the central zone of the ID and about 3-5 positions on the periphery of the ID (or 10-15 positions, if with minor damage to the directional pattern of peripheral beams, to remove weakly used peripheral feeders).

But the behavior of the distribution of active subscribers can be very changeable (ships and aircraft, road and rail transport, sparsely populated areas, etc). Therefore, the power consumption of the antenna will need to rely on the statistically worst case, and, given that the power consumption of the PA is weakly dependent on the number of rays served by it, the overall efficiency of the antenna will fall by 10-20 percent. Local gradients of heat dissipation over the surface of the ID are also possible.

This drawback is devoid an antenna with a focusing system in the form of an amplifying lens, since all PA in partial feeders of the lens serve all ray positions, with approximately the same amplitude distribution for each beam. At the same time, low-power amplifiers are used at the ID, and the radio-emitting element can be either a horn or a dipole (Variant 1).

In addition, it is possible to use a low-power, amplitude-modulated by radio signal, an optical channel between the ID and the focusing system (Variant 2). In this case, the focusing system can be both a feedthrough or a reflective amplifying lens.

The big advantage of this invention is that the amplifying lens consists of fairly simple unmanaged partial feeds with fixed delay lines and a heat release mode that is almost constant in time and uniform over the lens surface. Compared to the prototype, this will significantly reduce the problem of heat release due to its remoteness from the ID and the spacecraft, a larger area and an increase in the temperature of external heat radiating surfaces to 80-100 degrees.

It was noted above that phase shifters cannot be used in telecommunication antennas to deflect the beam. This implies the use of true time delays and a rather complicated beamforming system, for example, digital. In the present invention, this system can be much simpler due to the fact that for a receiving antenna it is necessary to analyze signals not from the entire array of partial feeds, as in classical AESA (at least a thousand feeds), but only from a subarray containing 100-200 feeds.

An antenna scheme is also possible, in which the ID is located so, that it overlaps the zone of intersection of the projections of the beams, and is not divided into sub-arrays.

Such a scheme is extremely inefficient, since it requires a significantly larger lens, and for each beam, only the subarray of the lens array corresponding to a given aperture is involved.

BRIEF DESCRIPTION OF THE DRAWINGS

Further, the invention is disclosed in more detail using graphic materials, where.

DETAILED DESCRIPTION OF ILLUSTRATIVE EMBODIMENTS

Figure 1:
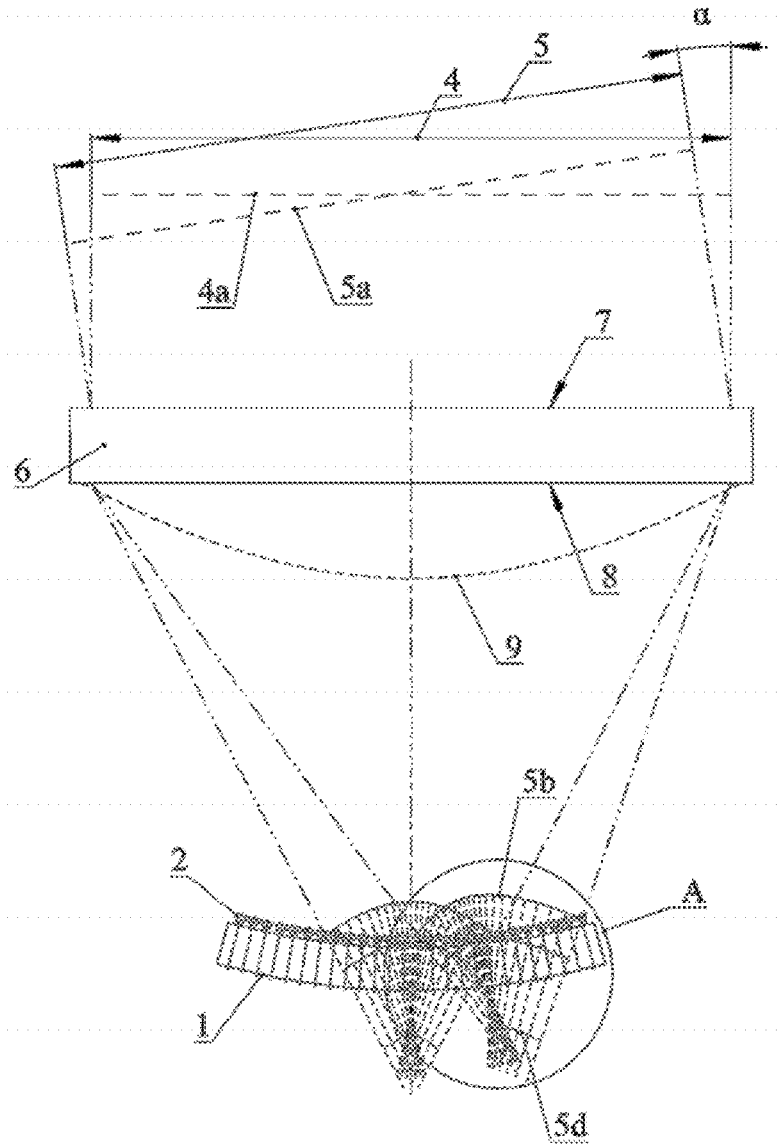
FIG. 1—is front view of the antenna (Variant 1)

For ease of perception, the following designations are common for both antenna variants:

The irradiating device 1, its feeders 2 and the radiating surface 3, formed by the phase centers of the feeders 2;

Apertures 4, 5 for deviation angles 0, α;

Plane wave fronts 4*a*, 5*a*, corresponding to apertures 4, 5;

Non-flat wave fronts equidistant to the front 5*a:*

5*b*—at the exit from the radiating surface 3 (the wave front touches the surface 3 at the point K1);

5*c*—at the entrance to the radiating surface 3 (the wave front touches the surface 3 at the point K2);

5*d*—in the zone of self-intersection of wave fronts;

Feeder 2*n* and distance Tn, which determines its time delay.

Amplifying lens 6, its radiating surface 7, receiving surface 8 and refracting surface 9, approximating the length of the delay lines of the partial feeders of the lens.

Figure 2:
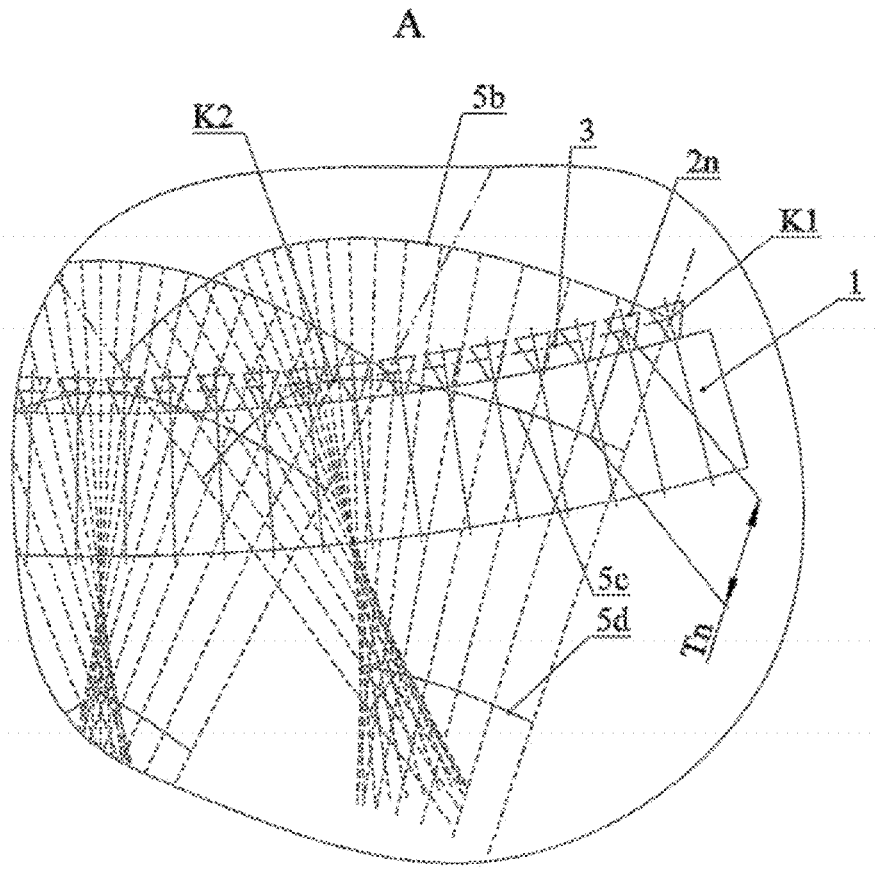
FIG. 2—is an enlarged fragment of A.

FIGS. 1 and 2 show an antenna according to Variant 1, consisting of an irradiating device 1 with feeders 2 and an amplifying lens 6. The irradiating device is made in the form of a concave sphere and the feeders 2 are directed so as to irradiate the surface 8 as effectively as possible.

Figure 3:
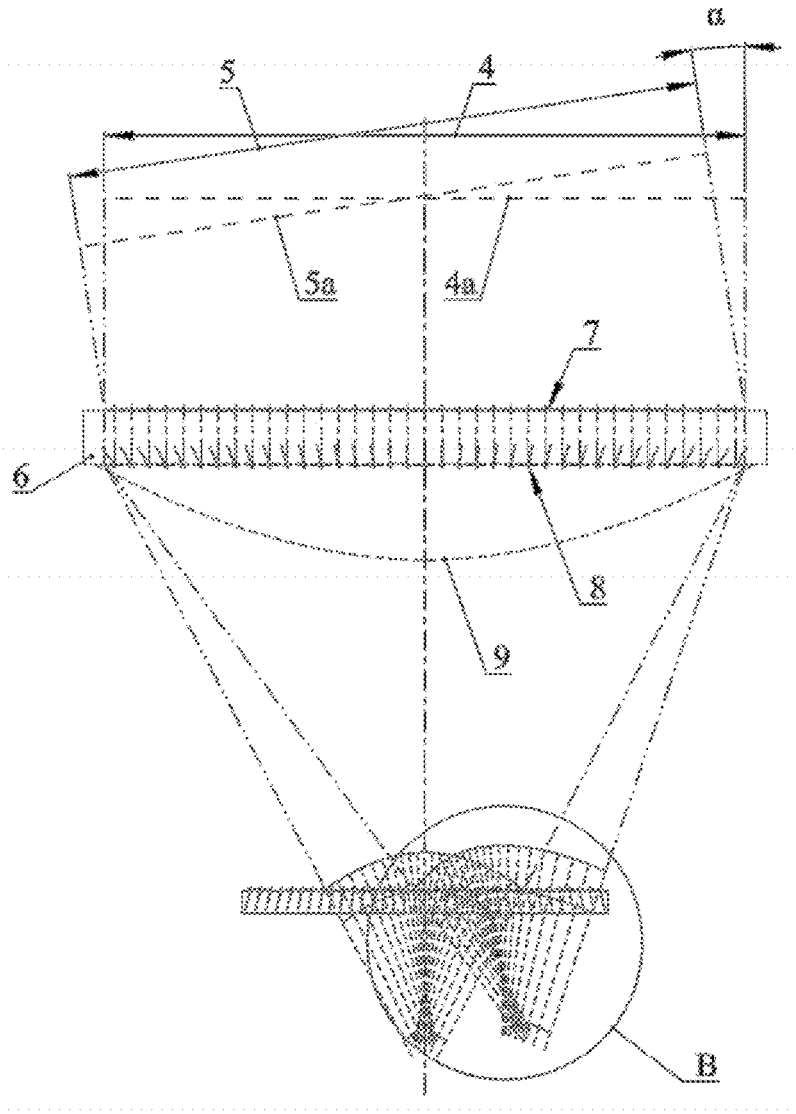
FIG. 3—is front view of the antenna (Variant 2)
Figure 4:
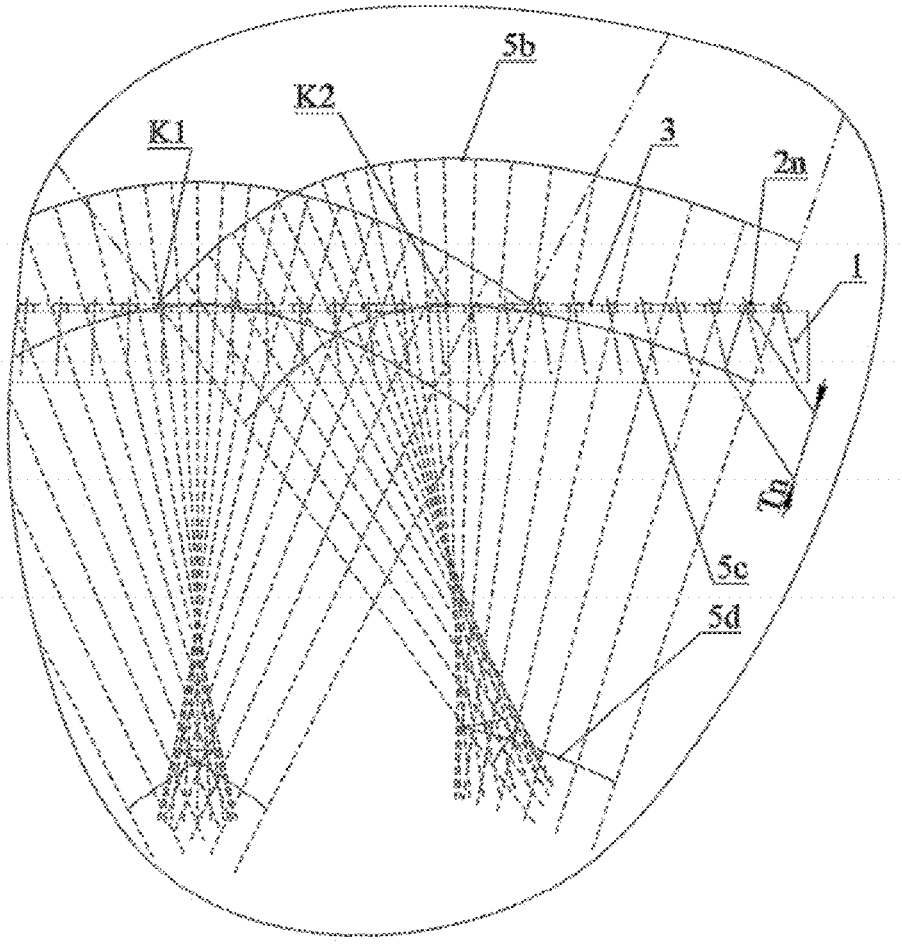
FIG. 4—is an enlarged fragment of B.

FIGS. 3 and 4 shows the antenna according to Variant 2, consisting of an optical irradiating device 1 with feeders 2 and an amplifying lens 6. In this embodiment, due to the simplicity of optical feeders 2, it is quite easy to ensure the individual direction of each feeder to the surface 8.

FIGS. 2 and 4 shows the principle of the formation of a wave front 5*c*, equidistant to wave front 5*a* in a given direction of the beam.

Front 5*c* can be constructed, for example, by reverse tracing from an arbitrary (up to a constant) plane 5*a* by the Monte Carlo method. In this case, the segment Tn determines the time delay for the partial feeder 2*n*, and the number of tracing rays in a certain neighborhood of its phase center, for example, at a distance of λ/2, its amplitude. Thus, it is possible to determine the amplitude-time parameters of the entire subarray of feeders for a given direction of the beam.

In both cases, the refractive surface 7 of the focusing system is designed as a surface with a continuous second derivative. If the continuity condition of the second derivative is not met, the refracted wave front will immediately intersect itself and cannot be reproduced by ID feeders.

It should be noted that in the context of the present invention, the concepts of "focal point" and "focal surface" lose their meaning. In this case, the refracting surface of the lens can be a surface of revolution, with a revolution axis that does not coincide both in angle and in position with the axes of the lens and/or the ID. Moreover, the refracting surface can be formed, for example, by pulling one, perhaps variable, curve along the other, guiding curve. The only requirement is that the self-intersection region of the non-planar front 5*d* must be outside the radiating surface 3. At the same time, a sufficiently large flexibility is provided in optimizing the scheme of the antenna for various configurations of the service area and spacecraft layout.

The implementation of the invention can be performed as follows:

Structurally, the antennas in both variants practically do not differ from the known schemes of lens antennas. At the same time, wider possibilities for optimizing the geometry of the antenna facilitate its integration into the layout of the spacecraft.

In the process of optimization, ray tracing is performed from arbitrary planes 5*a* in directions from given subscriber positions and the following are determined:

the geometry of the lens 6, its refracting surface 9, and the irradiating device 1;

amplitude-time parameters for each feeder 2 in each direction.

In the future, these tables of amplitude-time parameters, after some adjustments as a result of testing and operating the antenna, are used by the beam forming system.

All of the above is quite obvious, in the context of geometric optics and radio wave interference, for Variant 1.

Figure 5:
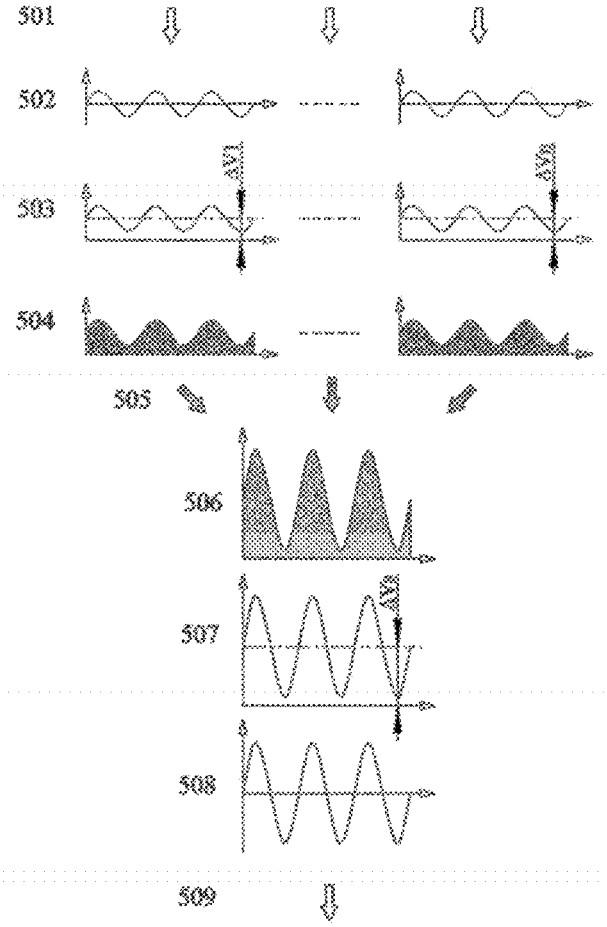
FIG. 5—is a diagram of the transformation of the electrical signal to ensure the interference of the amplitude-modulated optical signal.

In Variant 2, optical radiation amplitude-modulated by a radio signal is involved in the area between surfaces 3 and 8. FIG. 5 shows the principle of conversion of an electrical signal to ensure the interference of an amplitude-modulated optical signal:

501—incoming signals:

receiving antenna—radio emission from a given direction at the input of receivers of partial feeders of the lens;

transmitting antenna—electrical signals at the input of the feeders of the irradiating device from the beamforming system for a given direction;

502—electrical signals before conversion;

503—is the signal offset by the value of ΔV1 . . . ΔVn;

504—amplitude-modulated radiation of optical feeders;

505—light radiation between the lens and the irradiating device;

506—light radiation on the photodetector (interference by the amplitude of the light flux);

507—electrical signal from the photodetector;

508—signal shift by minus ΔVs;

509—output signal:

receiving antenna—an electrical signal from a given direction to the input of the repeater;

transmitting antenna—radio emission from each partial feeder of the lens for a given direction.

Of course, the signals 501 and 509 in this scheme are interpreted taking into account the time delays of the focusing system and the beamforming system for a given beam direction. If there is a discrepancy in phase (in the context of the invention—in time) of signals 501, then due to the offset minus ΔVs, signals 508 and 509 will approach zero (in accordance with the antenna pattern).

Thus, the principles of interference and geometrical optics in Variant 2 completely coincide with Variant 1.

The use of an active phased array as an irradiation device for an amplifying lens with the formation of non-planar wave fronts equidistant to flat wave fronts in given directions will allow to achieve the following advantages:

simplification of the beamforming system;

reducing the size of the antenna due to the "short focus" of the lens;

providing a large service area, with minimal loss of gain and beam width;

providing a large number of active beams;

provision of favorable thermal conditions for the antenna and the spacecraft;

providing great flexibility in optimizing the scheme of the antenna.

Thus, all the tasks of this invention are completed.

Although the present disclosure has been described with reference to one or more examples, workers skilled in the art will recognize that changes may be made in form and detail without departing from the scope of the disclosure and/or the appended claims.

The invention claimed is:

1. A multi-beam antenna comprising:

a focusing system;

an irradiating device designed to irradiate the focusing system, comprising a two-dimensional array of feeders, placed at a distance from the focusing system and overlapping a zone of beam projections at this distance; and a beamforming system, which serves at least one subarray of feeders of the two-dimensional array of feeders, providing one beam in a given direction, wherein the focusing system is designed as an amplifying lens, and for each such beam, the beamforming system provides amplitude-time parameters of a transmitted signal for each feeder in the corresponding subarray, to form a non-planar wave front, which is equidistant across the amplification lens to a planar wave front of the beam, while the radiating surface of the irradiation device is outside a self-intersection zone of non-planar wave fronts.

2. A multi-beam antenna comprising:

a focusing system;

an irradiating device designed to irradiate the focusing system, comprising a two-dimensional array of feeders, placed at a distance from the focusing system and overlapping an area of beam projections at this distance; and a beamforming system, which serves at least one sub-array of feeders of the two-dimensional array of feeders, providing one beam in a given direction, wherein the focusing system is designed as an amplifying lens with partial feeders, containing photodetectors on a side of the irradiation device, and the irradiating device contains feeders in the form of light sources are amplitude-modulated by a radio signal, and for each such beam, the beamforming system provides amplitude-time parameters for each feeder in the corresponding sub-array, to form a non-planar wave front of an amplitude-modulated signal, which is equidistant across the amplifying lens to a plane wave front of such a beam, and wherein a radiating surface of the irradiation device is outside a self-intersection zone of non-planar wave fronts.

3. The multi-beam antenna according to claim 1, wherein a refractive surface of the amplifying lens is designed as a surface of revolution with a continuous second derivative and an axis of revolution that does not coincide in at least one of an angle or a position with axes of at least one of the amplifying lens or the irradiating device.

4. The multi-beam antenna according to claim 1, wherein a refractive surface of the amplifying lens is designed as a pulling surface of forming curves with a continuous second derivative.

5. The multi-beam antenna according to claim 2, wherein a refractive surface of the amplifying lens is designed as a surface of revolution with a continuous second derivative and an axis of revolution that does not coincide in at least one of an angle or a position with axes of at least one of the amplifying lens or the irradiating device.

6. The multi-beam antenna according to claim 2, wherein a refractive surface of the amplifying lens is designed as a pulling surface of forming curves with a continuous second derivative.

7. The multi-beam antenna according to claim 4, wherein the refractive surface of the amplifying lens is designed as a pulling surface of a variable forming curve along a guiding curve.

8. The multi-beam antenna according to claim 6, wherein the refractive surface of the amplifying lens is designed as a pulling surface of a variable forming curve along a guiding curve.

* * * * *